US005725129A

United States Patent [19]

Chapin et al.

[11] Patent Number: 5,725,129

[45] Date of Patent: Mar. 10, 1998

[54] DUAL-CONTAINER FOAM DISPENSER

[75] Inventors: David S. Chapin; Charles E. Hughes; Steven G. Palmer, all of Raleigh, N.C.; Matthew Williams, Wooster, Ohio

[73] Assignee: American Sterilizer Company, Mentor, Ohio

[21] Appl. No.: 465,952

[22] Filed: Jun. 6, 1995

[51] Int. Cl.[6] ..... B67D 5/06

[52] U.S. Cl. ..... 222/190; 222/195; 261/122.2

[58] Field of Search ..... 239/343; 222/450, 222/190, 562, 179, 181.3, 187, 195, 183, 399, 401, 630, 631, 400.7, 189.11, 130, 131, 136, 145.1, 145.5, 145.6; 261/122.1, 122.2, DIG. 26

[56] References Cited

U.S. PATENT DOCUMENTS

| | | | |
|---|---|---|---|
| Re. 33,564 | 4/1991 | Ford, Jr. . | |
| 2,103,687 | 12/1937 | McKenney . | |
| 2,319,244 | 5/1943 | Cascio, et al. . | |
| 2,680,010 | 6/1954 | Dubay . | |
| 3,197,081 | 7/1965 | Midworth . | |
| 3,308,993 | 3/1967 | Bruno . | |
| 3,323,689 | 6/1967 | Elmore . | |
| 3,346,146 | 10/1967 | Thompson . | |
| 3,422,993 | 1/1969 | Boehm, et al. . | |
| 3,428,222 | 2/1969 | Wright . | |
| 3,622,049 | 11/1971 | Thompson . | |
| 3,709,437 | 1/1973 | Wright . | |
| 3,937,364 | 2/1976 | Wright . | |
| 3,952,924 | 4/1976 | Benson . | |
| 3,973,701 | 8/1976 | Gardner . | |
| 3,985,271 | 10/1976 | Gardner . | |
| 4,018,364 | 4/1977 | Wright . | |
| 4,022,351 | 5/1977 | Wright . | |
| 4,027,789 | 6/1977 | Dickey . | |
| 4,030,665 | 6/1977 | Koyama | 261/DIG. 26 |
| 4,044,923 | 8/1977 | Gardner . | |
| 4,046,289 | 9/1977 | Teranishi . | |
| 4,098,434 | 7/1978 | Uhlig . | |
| 4,147,306 | 4/1979 | Bennett . | |
| 4,156,505 | 5/1979 | Smith . | |
| 4,219,159 | 8/1980 | Wesner . | |
| 4,274,594 | 6/1981 | Ito . | |
| 4,349,131 | 9/1982 | Arabian . | |
| 4,531,659 | 7/1985 | Wright . | |
| 4,531,660 | 7/1985 | Ford, Jr. . | |
| 4,596,343 | 6/1986 | Ford, Jr. . | |
| 4,640,440 | 2/1987 | Ford, Jr. et al. . | |
| 4,846,376 | 7/1989 | Palmer . | |
| 4,880,161 | 11/1989 | Wright . | |
| 4,901,925 | 2/1990 | Blake, III . | |
| 4,932,567 | 6/1990 | Tanabe, et al. . | |
| 4,957,218 | 9/1990 | Ford, Jr. . | |
| 4,993,599 | 2/1991 | Gruenewald . | |
| 5,219,102 | 6/1993 | Wright . | |
| 5,222,633 | 6/1993 | Blake . | |
| 5,269,444 | 12/1993 | Wright | 222/190 |
| 5,411,177 | 5/1995 | Blake, III | 222/400.7 |
| 5,439,140 | 8/1995 | Meyer | 222/190 |

*Primary Examiner*—Philippe Derakshani

*Attorney, Agent, or Firm*—Fay, Sharpe, Beall, Fagan, Minnich & McKee

[57] ABSTRACT

An inner container is disposed within an outer container containing an amount of foamable liquid sufficient to provide a substantial foam production capacity. The dual-container foam dispenser is provided with a porous diffusing element having material surface characteristics optimally suited for diffusing pressurized air into stationary foamable liquid located within the inner container, thereby producing high-quality foam. The inner container is provided with an upper valve and a lower valve, each biased open by a return-action biasing force. The valves open to permit flow in either direction between the containers, depending upon system pressure changes during different stages in the foam production cycle, to prevent leakage of foam out of the device and to permit refilling the inner container.

10 Claims, 3 Drawing Sheets

DUAL-CONTAINER FOAM DISPENSER

BACKGROUND OF THE INVENTION

This invention relates generally to non-aerosol foam dispensing devices, and particularly to a dual-container foam dispenser that produces a superior quality of foam by diffusing pressurized air through stationary foamable liquid with substantially no leakage of foam out the spout of the dispenser after the pump is relaxed.

Early foam dispensers were essentially hand-held squeeze bottles. When squeezed, foam was produced by the agitation created by the mixing of the flowing streams of foamable liquid and air in a distinct mixing chamber or area. Alternatively, when squeezed, foam was produced by air flowing through foamable liquid absorbed into a sponge-like foam producing element. The squeeze bottles were equipped with a check valve that prevented backflow of liquid and foam from the mixing chamber or spout. Because they were designed to be handheld and operated, these early foam dispensers were limited in size. Hence, they had a small foam production capacity and had to be refilled frequently. Thus, they were not convenient in situations where large quantities of foam were required due to, for example, frequent need for foam. In addition, squeezing occupied the user's hands which, for some uses, was inconvenient, unsanitary, or inefficient.

In an effort to overcome these capacity and handling problems, foam dispensers having a dual-container configuration were developed. Generally, these devices included a conventional container having a capacity substantially greater than the squeeze bottles to serve as the outer container in the dual-container configuration. A small container was disposed within the large, outer container, and in fluid connection via a single one-way flow container valve located at or near the bottom of the inner container. Like many of the squeeze bottles, these devices generally produced foam by mixing flowing streams of air and foamable liquid in a distinct mixing chamber or area outside of or adjacent to the containers. The valve was a passive valve that permitted fluid flow only in one direction. It permitted the flow of foamable liquid from the outer container to the inner container to refill the inner container, but prevented the backflow of foamable liquid from the inner container to the outer container. Additional one-way flow valves separated the mixing chamber or area from the containers, preventing backflow from the mixing area into the containers.

These dual-container foam producers solved the capacity problem and freed the user's hands (provided that air was supplied using a foot pump or similar means). These devices, however, had other drawbacks. In particular, during use the air pressure in the inner container increased substantially, and the inability to relieve this increased air pressure often caused unwanted leakage of foam and foamable liquid out of the device between uses.

The present invention provides a dual-container foam dispenser having a foam production capacity comparable to that of other dual-container foam dispensers. Unlike prior dispensers which contained valves to prevent backflow from the inner container to the outer container, the present invention contains valves chosen to selectively permit such backflow to prevent unwanted leakage of foam and foamable liquid between uses, and to permit foam to exit the inner container so that it can be replaced by foamable liquid.

SUMMARY OF THE INVENTION

The foam dispenser of the present invention is a dual-container foam dispenser comprising an outer container for receiving a foamable liquid. An inner container is disposed within the outer container and comprises an upper valve and a lower valve. Each valve further comprises urging means for forcing the valve open to provide a fluid connection between the outer and inner containers.

A porous diffusing element, having pores that are substantially uniform and microscopic, is disposed within the inner container. A pressurized air supply, operative between an activated state and a relaxed state, is provided in fluid connection with the diffusing element. A foam outlet in fluid connection with the inner container is provided above the upper valve.

When the air supply is activated, air is supplied to and through the pores of the diffusing element and sufficient pressure is created within the inner container to overcome the force of the urging means, thereby closing each valve and substantially precluding fluid flow between the inner and outer containers. The pressurized air bubbles up from the pores of the diffusing element, generating a foam from the foamable liquid in the inner container substantially external to the diffusing element. The increased pressure forces the foam upward through the inner container, through a homogenizing filter, and out of the foam dispenser through the foam outlet.

When the air supply is relaxed, each valve is forced open by the urging means, alleviating the pressure gradient existing from the inner container to the outer container. Fluid flow is thus permitted to flow from the inner container to the outer container through each valve to prevent leakage of foam out of the foam outlet. Once the pressure in the inner container is fully released, the valves permit fluid flow from the outer container to the inner container until the levels of fluid in the inner and outer containers are equalized.

The present invention also provides a method for producing foam using a dual-container foam dispenser of the type described above.

DETAILED DESCRIPTION OF THE INVENTION

Figure 1:
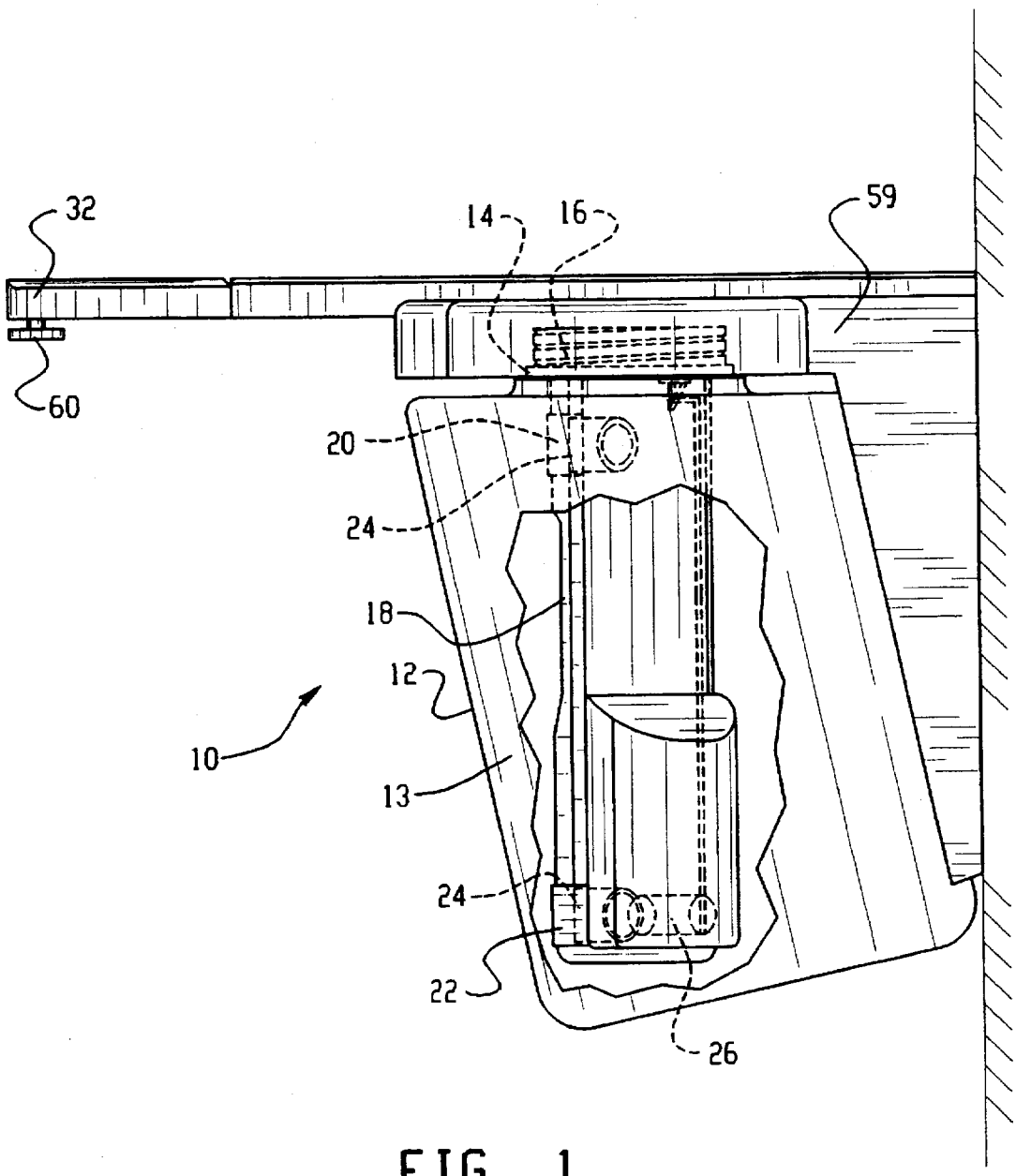
FIG. 1 is a side view of the foam dispenser of the present invention.
Figure 2:
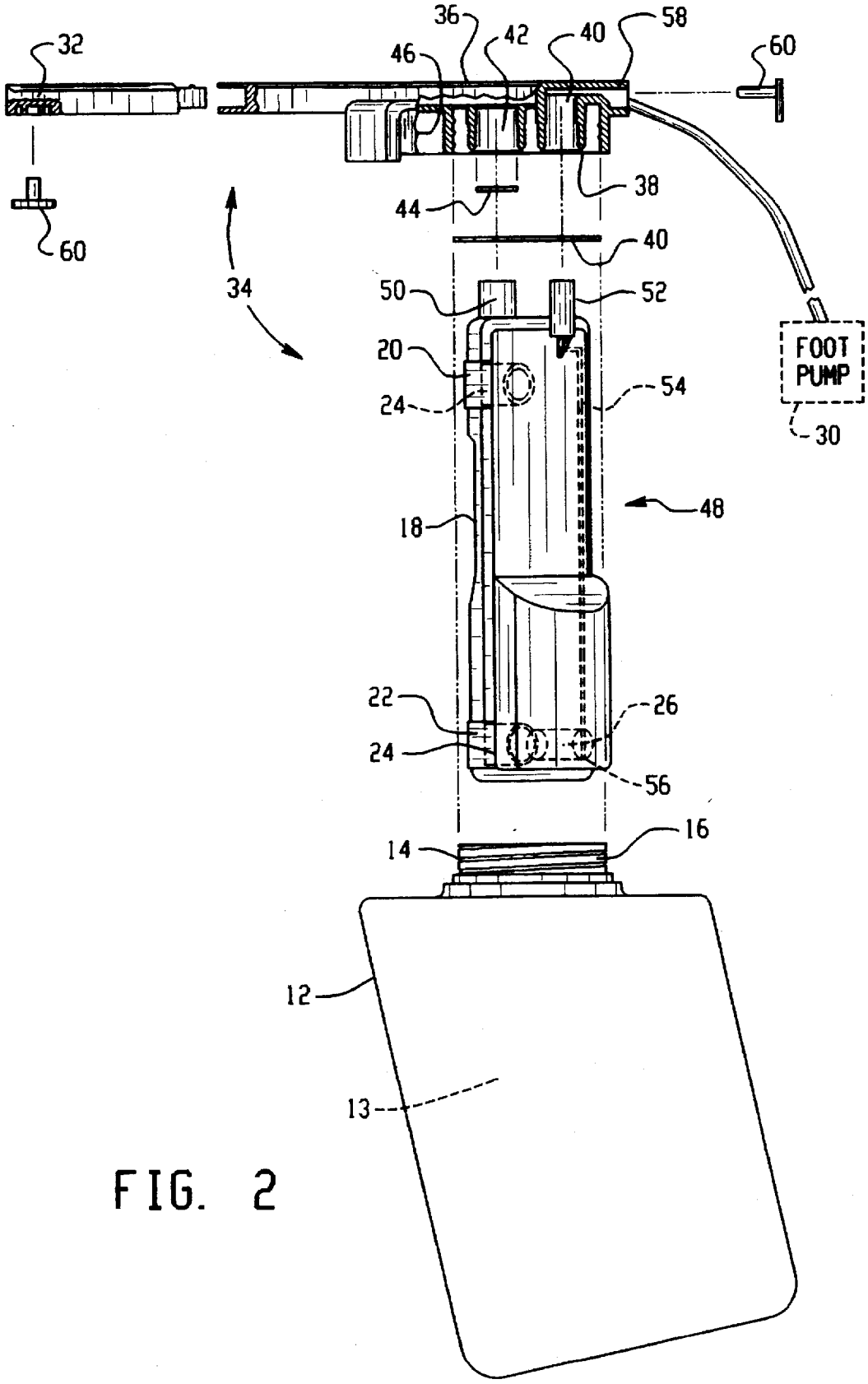
FIG. 2 is a side view of the foam dispenser of the present invention in exploded form.
Figure 4:
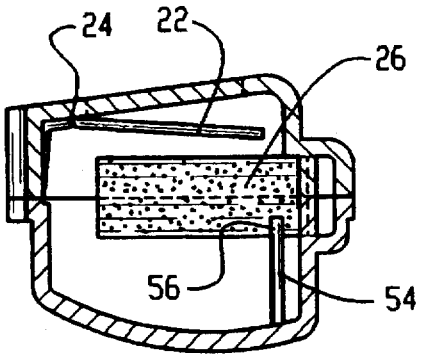
FIG. 4 is a sectional view taken along the line 4—4.

Referring now by reference numerals in the drawings, a preferred embodiment of the foam dispenser of the present invention is generally indicated by reference numeral 10. As best seen in FIGS. 1 and 2, the foam dispenser comprises outer container 12 having neck 14 with ratchet teeth 16 located at the base of the neck. Outer container 12 is of sufficient size to provide a foam production capacity comparable to that of other dual-container foam dispensers, and may be formed of any suitable rigid or non-rigid material such as metal or plastic. Preferably, outer container 12 is made of high-density polyethylene or some other recyclable plastic for easy disposal. Outer container 12 is filled with a foamable liquid 13 and may act as a storage vessel for foamable liquid when the foam dispenser is not in use. The body of outer container 12 may be at an angle with neck 14 to tilt the container to allow increased access to the foamable liquid near the bottom of the container, thereby permitting maximum use of the foamable liquid.

Inner container 18 is disposed within outer container 12, and is in fluid connection with foam outlet 32 where foam exits the device. Inner container 18 comprises upper valve 20 and lower valve 22. In contrast to valves used in prior devices, valves 20 and 22 are intentionally selected to comprise an urging means 24 having a return-action force that forces the valves open to provide a fluid connection between inner container 18 and outer container 12. The return-action force may be provided by incorporating a living hinge into valves 20 and 22, although valves containing other mechanisms known in the art to provide a return-action force may be selected.

Diffusing element 26 is disposed near the bottom of inner container 18. Diffusing element 26 is a tube, preferably cylindrical, made of a porous material substantially permeable to air. Preferably, diffusing element 26 is made from a molded sintered high-density polyethylene material. The inventors have discovered that sintered polyethylene, when molded into a tube, has surface characteristics optimally suited for producing high-quality foam. In particular, the diffusing element so fashioned contains substantially microscopic, substantially uniform pores.

Pressurized air supply 30 is provided in fluid connection with the diffusing element 26. In order to leave the user's hands free, pressurized air supply 30 preferably is a foot pump, although various other types of devices for supplying pressurized air known to those skilled in the art could be used with this invention.

Foam is produced as follows. First, outer container 12 is filled with a foamable liquid. Inner container 18, with diffusing element 26, is then disposed within the outer container. The device is now ready for repeatedly dispensing foam as follows. The urging means 24 forces valves 20 and 22 open to permit foamable liquid to flow from the outer container to the inner container, thereby filling the inner container to a level equal to that in the outer container. Pressurized air supply 30 selectively supplies air under pressure (i.e., the foot pump is pressed). When the foot pump is depressed, the pressure in the system increases substantially. Such pressure is large enough to overcome the return-action force of valves 20 and 22, forcing valves 20 and 22 to close. This substantially precludes the flow of foamable liquid between the containers, ensuring that the foamable liquid in the inner container remains there for foam production. The pressurized air flows to diffusing element 26 and is forced through the pores creating numerous tiny bubbles substantially external to the diffusing element. Thus, in contrast to the sponge-like materials used in certain prior devices, the diffusing element should be positioned so that the entire diffusing element is submerged, allowing the maximum surface area to be available for diffusing the air into the foamable liquid. The air bubbles then bubble up from the surface of diffusing element 26 through the stationary foamable liquid 13 located within inner container 18, thereby producing foam. In this manner, the foam is produced substantially external to the diffusing element and within the inner container itself, rather than, in contrast to prior devices, in an additional mixing chamber or area.

The bubbling action generated by diffusing element 26 can produce high-quality foam from a variety of foamable liquids having a wide range of viscosities. Examples of foamable liquids for use in conjunction with this device include 2% CHG, 4% CHG, 3% PCMX, and 0.75% PVP Iodine, although any foamable liquid commonly used in hospitals or alternate care facilities may be used. The foam is forced under pressure out of inner container 18, through a homogenizing filter 44 to produce a high-quality foam having substantially uniform bubbles, and out through foam outlet 32.

In a preferred embodiment, best seen in FIG. 2, the foam dispenser comprises a cap/pump card assembly, referred to generally as 34, which contains the structures that produce the foam. Cap 36 has an underside 38 on which to place sealing gasket 40. Cap 36 also contains inlet passage 40 and outlet passage 42. Inlet passage 40 receives pressurized air from pressurized air supply 30. Outlet passage 42 is fitted with a homogenizer 44, which further refines the foam produced in the inner container. Outlet passage 42 also is in fluid connection with foam outlet 32. Cap 36 also contains inner threads 46 designed to mate with ratchet teeth 16 in neck 14 of outer container 12.

Figure 3:
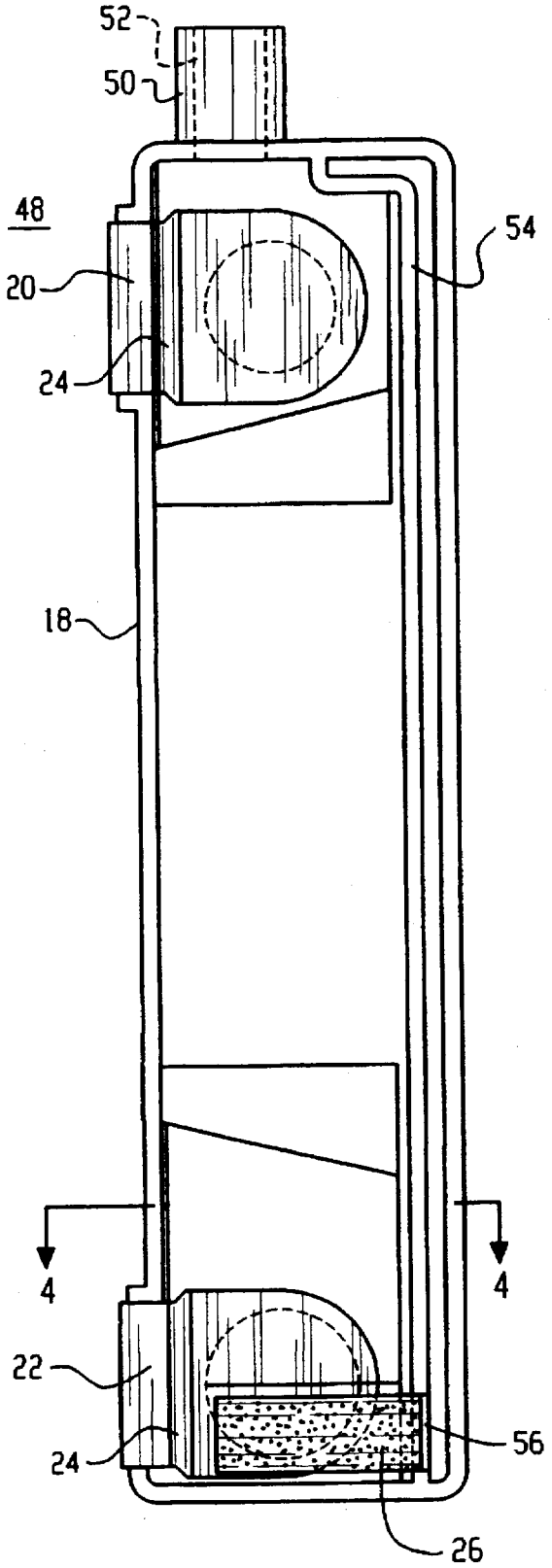
FIG. 3 is a side view of the pump card component of the foam dispenser of the present invention.

The pump card, depicted in FIG. 3 and referred to generally by reference numeral 48, comprises inner container 18. Pump card 48 also comprises outlet tube 50, inlet tube 52, and air tube 54 depending from inlet tube 52. Preferably, pump card 48 is made of a rigid plastic material such as high-density polyethylene. Pump card 48 preferably is manufactured in two halves. Each half is individually made by injection molding high-density polyethylene into the various structures listed above. The mold for each half is suited to form air tube 54. Air tube 54 has end 56 to which diffusing element 26 is mated. Once the diffusing element is secured, the two halves are welded together to form pump card 48.

Inlet tube 52 and outlet tube 50 of pump card ¢8 may be snapped into inlet passage 40 and outlet passage 42 of cap 36 respectively to form cap/pump card assembly 34. Inner threads 46 of cap 36 can mate with ratchet teeth 16 of outer container 12 to form a substantially permanent seal between cap/pump card assembly 34 and outer container 12. In this fashion, inner container 18 is disposed within outer container 12. In one embodiment, the end user fills the outer container with a foamable liquid, and then assembles the main components of the dispenser as just described. Alternatively, the assembly can be completed at the manufacturing stage, and the container can be sold as an assembled unit with the outer dispenser already filled with foamable liquid. Cap 36 also has a ridge 58 or other means known in the art by which the dispenser may be fitted to a wall bracket or stand 59. The foam dispenser may be provided with end plugs 60 to close off inlet passage 40 and foam outlet 22. End plugs 60 are not necessary to this invention and are not used during foam production, but prevent leakage in situations, such as transport of the device, when sudden and rough jostling of the device may occur.

Foam is produced as follows. When pressurized air supply 30 supplies air, pressurized air travels through inlet passage 40 of cap 36 and inlet tube 52 of pump card 48, down through air tube 54 to diffusing element 26. The pressurized air is forced through the pores of diffusing element 26 creating foam in the manner described previously. The foam is forced under pressure through outlet tube 42 and through homogenizer 44, which further refines the foam. The foam then passes through outlet passage 42 of cap 36 and exits the device through foam outlet 32.

Valves 20 and 22 operate as follows to prevent leakage of foam and foamable liquid out of the device, and to permit refilling inner container 18 with foamable liquid from outer container 12, between uses. When the foot pump is relaxed, the pressure in inner container 18 begins to fall, but initially remains above atmospheric pressure. Without valves 20 and 22, therefore, foam would continue under the increased pressure to be forced out of the device. Instead, valves 20 and 22 release the pressure in inner container 18 to prevent such leakage. The return-action force of urging means 24 is sufficient to overcome the pressure present immediately after relaxing the foot pump. Thus, valves 20 and 22 open, releasing the pressure in inner container 18, to allow foam and foamable liquid to flow backward from inner container 18 into outer container 12, rather than leak out of the device.

The pressure in inner container 18 continues to fall, approaching atmospheric pressure, until the pressure exerted due to the height of the foamable liquid in outer container 12 overcomes the air pressure in inner container 18. At that point, foamable liquid flows from outer container 12 into inner container 18 through one or both of valves 20 and 22 (depending on the level of the liquid), thereby refilling inner container 18. The device is now ready for another cycle. Thus, in contrast to prior valves, valves 20 and 22 selectively permit flow in either direction—backflow is permitted to prevent leakage and forward flow is permitted to allow refilling the inner container in response to pressure changes in the system during use.

The foam dispenser of the present invention is designed for easy recycling. The entire dispenser preferably is made from recyclable plastic such as, as stated above, high-density polyethylene. When substantially all of the foamable liquid in the outer container is exhausted, the entire dispenser comprising the outer container and the cap/pump card assembly can be removed from the wall bracket or stand in one piece and recycled as a unit. The user then replaces the old unit with a new dispenser. This disposability also eliminates the need to clean the foam dispensing system, which for nondisposable dispensers, is often a laborious and time consuming task.

While a certain preferred embodiment of this invention has been described, it is understood by those skilled in the art that many modifications are possible without departing from the principles of this invention as defined in the claims that follow.

We claim:

1. A dual-container foam dispenser comprising:

an outer container for receiving a foamable liquid;

an inner container disposed within the outer container and comprising an upper valve and a lower valve, each valve being biased open with a biasing force to provide fluid communication between the outer and inner containers;

a porous diffusing element disposed within the inner container in communication with an air receiving passage which selectively receives pulses of air under pressure, the pores of the diffusing element being substantially uniform and microscopic;

a foam outlet in fluid connection with the inner container and located above the upper valve;

a homogenizing filter disposed between the inner container and the foam outlet;

wherein when the pulse of air under pressure is supplied to and through the pores of the diffusing element and into the inner container, (i) a sufficient pressure is created within the inner container to overcome the biasing force of the upper and lower valves closing each valve and substantially precluding fluid flow between the inner and outer containers, (ii) the flow of air through the diffusing element pores into the inner container generates a foam from the foamable liquid in the inner container substantially external to the diffusing element, and (iii) forces the foam upward through the inner container, through the homogenizing filter, and out the foam dispenser through the foam outlet; and wherein when pressure in the inner container falls below the biasing force alleviating any pressure gradient existing between the inner and outer containers, fluid flow is permitted in either direction between the inner and outer containers through the upper and lower valves to prevent leakage of foam out of the foam outlet and permit the levels of any fluids in the inner and outer containers to become equalized.

2. The dual-container foam dispenser according to claim 1 wherein the diffusing element includes molded, sintered polyethylene.

3. A method of producing foam using a dual-container foam dispenser including an outer container filled with a foamable liquid, a porous diffusing element in an inner container, the pores of the diffusing element being substantially uniform and microscopic, the inner container being disposed within the outer container and having a foam outlet, an upper valve, and a lower valve which valves are both biased open to provide fluid communication between the outer and inner containers, the foam outlet being disposed above the upper valve, closing both the upper and lower valves substantially precludes fluid flow between the inner and outer containers, the method comprising:

supplying air under pressure to the diffusing element, the air bubbling through the diffusing element (1) to increase pressure in the inner container sufficient to close the valves and (2) to generate a foam from the liquid in the inner container substantially external to the diffusing element;

continuing to supply the air under pressure for a time period effective to force a desired amount of the foam upward through the inner container and through homogenizing filter, and out of the foam dispenser through the foam outlet;

terminating supplying the air under pressure such that the valves open to release pressure in the inner container and permit foam and foamable liquid in the inner container to flow back into the outer container through at least one of the valves so that substantially none of the remaining foam and foamable liquid passes out of the foam dispenser through the foam outlet, the fluid levels in the inner and outer containers becoming substantially equal.

4. A cap/pump card assembly for use in a dual-container foam dispenser comprising:

a cap having an air inlet passage which selectively receives pressurized air and a foam outlet passage;

a pump card comprising:

an inner container, an upper valve in an upper portion of the inner container, and a lower valve in a lower portion of the inner container, each valve being biased open;

a porous diffusing element with microscopic pores disposed within the inner container;

an air inlet tube fluidly connected with the diffusing element for selectively supplying pressurized air thereto; and a foam outlet tube extending from the inner container above the upper valve;

wherein the pump card can be inserted into the cap with the air inlet tube in fluid connection with the air inlet passage and the foam outlet tube in fluid connection with the foam outlet passage.

5. The cap/pump card assembly according to claim 4 wherein the diffusing element comprises molded sintered polyethylene.

6. A dual-container foam dispenser comprising:

a cap/pump card assembly comprising a cap having an inlet passage and an outlet passage; a pump card comprising an inner container comprised of an upper valve and a lower valve, wherein each valve is biased open; a porous diffusing element disposed within the inner container, wherein the pores of the diffusing element are substantially uniform and microscopic; an inlet tube; an air tube fluidly connected between the inlet tube and the diffusing element in the inner container; and an outlet tube extending above the upper valve; wherein the pump card can be inserted into the cap with the inlet tube in fluid connection with the inlet passage and the outlet tube in fluid connection with the outlet passage;

an outer container for receiving a foamable liquid in which the pump card can be disposed and over the cap can be secured;

a foam outlet in fluid connection with the inner container and located above the upper valve;

a homogenizing filter disposed between the inner container and the foam outlet;

wherein when air is supplied to and through the pores of the diffusing element and into the inner container, a sufficient pressure is created within the inner container to close each valve and substantially precluding fluid flow between the inner and outer containers; and thereby generating a foam from the foamable liquid in the inner container substantially external to the diffusing element and forcing the foam upward through the inner container and through the homogenizing filter, and out of the foam dispenser through the foam outlet; and wherein when the supply of air is terminated, each valve opens alleviating any pressure gradient existing between the inner and outer containers and permitting fluid flow in either direction between the inner and outer containers through each valve to prevent leakage of foam out of the foam outlet and permit the levels of any fluids in the inner and outer containers to become equalized.

7. The dual-container foam dispenser according to claim 6 wherein the diffusing element comprises molded sintered polyethylene.

8. A foam dispenser comprising:

an outer container for receiving a foamable liquid;

an inner container disposed within the outer container;

a valve assembly disposed to provide selective fluid communication between the inner and outer containers, the valves being biased open to provide for fluid level equilibrium between the inner and outer containers;

a microporous diffusing element having microscopic pores, the microporous diffusing element being disposed within the inner container and connected in fluid communication with a source of air under pressure such that air under pressure received by the microporous diffusing element flows through the pores foaming the foamable liquid within the inner container substantially external to the microporous diffusing element;

a foam outlet in fluid communication with an upper portion of the inner container through which the foamed liquid is discharged.

9. The foam dispenser according to claim 8 wherein the microporous diffusing element includes a tube of sintered plastic.

10. A method of producing foam comprising:

forcing air under pressure through pores of a microporous sintered plastic diffusion element which is immersed in a foamable liquid in a container, the air forced through the pores of the microporous, sintered plastic diffusion element foaming the liquid external to the microporous sintered diffusion element and causing foam to rise within the container, through a foam discharge opening, and raising pressure in the container;

after a selected amount of foam has been discharged, terminating the supplying of air under pressure to the microporous, sintered diffusion element dropping pressure within the container and terminating the discharge of foam;

after dropping the pressure, replenishing the foamable liquid in the container.

* * * * *